US006945316B2

(12) United States Patent
Schildmann et al.

(10) Patent No.: US 6,945,316 B2
(45) Date of Patent: Sep. 20, 2005

(54) SYSTEM FOR CLEANING TUBES OF HEAT EXCHANGERS AND CLEANING BODIES THEREFOR

(75) Inventors: Hans-Werner Schildmann, Heiligenhaus (DE); Dietmar Altegoer, Witten (DE); Rainer Kretzschmar, Witten (DE)

(73) Assignee: Taprogge GmbH, Wetter (DE)

( * ) Notice: Subject to any disclaimer, the term of this patent is extended or adjusted under 35 U.S.C. 154(b) by 0 days.

(21) Appl. No.: 10/288,632

(22) Filed: Nov. 5, 2002

(65) Prior Publication Data

US 2004/0083565 A1 May 6, 2004

(51) Int. Cl.[7] ..... B08B 9/055
(52) U.S. Cl. ..... 165/95; 15/3.51; 15/104.061
(58) Field of Search ..... 165/95, 108, 159; 15/3.51, 104.061, 104.05

(56) References Cited

U.S. PATENT DOCUMENTS

| | | | | | |
|---|---|---|---|---|---|
| 1,597,850 | A | | 8/1926 | Weis | |
| 1,668,438 | A | | 5/1928 | Weis | |
| 3,616,113 | A | * | 10/1971 | Sawyer | 220/683 |
| 3,651,530 | A | * | 3/1972 | Schultz | 15/104.061 |
| 3,819,514 | A | * | 6/1974 | Clampitt et al. | 210/671 |
| 3,888,768 | A | * | 6/1975 | Graybill | 210/223 |
| 3,946,455 | A | | 3/1976 | Echols et al. | |
| 4,556,102 | A | * | 12/1985 | Bochinski et al. | 165/95 |
| 4,569,097 | A | * | 2/1986 | Echols | 15/104.061 |
| 4,733,718 | A | | 3/1988 | Schikowsky et al. | |
| 5,473,787 | A | | 12/1995 | Echols | |
| 5,630,471 | A | * | 5/1997 | Taprogge | 165/95 |
| 5,983,994 | A | * | 11/1999 | Tsou | 165/94 |
| 6,014,789 | A | | 1/2000 | Knapp | |
| 6,272,713 | B1 | * | 8/2001 | Lotwin | 15/104.061 |
| 6,530,427 | B1 | * | 3/2003 | Jackson | 165/303 |

FOREIGN PATENT DOCUMENTS

| | | | | |
|---|---|---|---|---|
| DE | 93 09 320 | | 11/1994 | |
| EP | 0 053 355 | | 6/1982 | |
| GB | 1356460 | | 6/1974 | |
| JP | 58014000 A | * | 1/1983 | F28G/1/12 |
| JP | 59 180300 | | 2/1985 | |
| JP | 06101991 A | * | 4/1994 | F28G/1/12 |

* cited by examiner

*Primary Examiner*—Tho V Duong
(74) *Attorney, Agent, or Firm*—Bachman & LaPointe, PC

(57) ABSTRACT

In a system for cleaning tubes of heat exchangers flown through by a fluid medium, in particular crude oil, having a temperature in excess of 120° C., wherein, for cleaning a tube, deposits such as dirt particles or the like adhering to its inner wall are detached by cleansing off and carried out of the tube, for cleaning the inner wall of the heat exchanger tubes during the operation of the heat exchanger, it is provided that cleaning bodies withstanding high temperatures (in excess of 120° C.) as well as withstanding aggressive fluid media such as crude oil and having outer dimensions when cleaning equal to the inner diameter of the tube to be cleaned and having an outer contact surface suitable for cleansing off deposits from an inner wall of a tube, pass through the tube due to the pressure of the fluid medium and are pressed to the inner wall of the tube by a contact pressure, and that, during the passage of the cleaning bodies, deposits adhering to the inner wall of the tube are caught and detached by the contact surface of the cleaning bodies and carried along by the fluid medium and/or the cleaning body and carried out of the tube.

15 Claims, 5 Drawing Sheets

SYSTEM FOR CLEANING TUBES OF HEAT EXCHANGERS AND CLEANING BODIES THEREFOR

The invention relates to a system for cleaning tubes of heat exchangers flown through by a fluid medium, in particular crude oil, having a temperature in excess of 120° C., wherein for cleaning a tube, deposits such as dirt particles and the like adhering on the inner wall thereof are detached by cleansing, and carried out of the tube.

In crude oil processing, tube bundle heat exchangers, particularly so-called crude oil heaters (COH) are used to heat the crude oil using process waste heat in pre-heating stages to an operating temperature that is as high as possible, before, in the final heater and using external energy, it is heated to the temperature necessary for the crude oil passing to distillation.

Heating the crude oil is carried out in stages over a plurality of parallel and series connected COH heat exchangers. The tubes of the heat exchanger are heated from the outside using the processing medium. Due to the heat transfer at the tubes of the heat exchanger there are deposits and caking of particles from the crude oil flow on the inside of the tube. These degrade the heat transfer leading to a lessened heating of the crude oil while still consuming the same amount of energy.

The formation of deposits and caking on the tube inner wall is chemically counteracted by adding additives in controlled amounts to the crude oil before introducing it into the heat exchanger. Due to this the deposit usually stays soft and can be more easily removed by mechanical means when compared to fast adhering cakings. However, the use of additives does not prevent deposit formation, but only delays it. The heat transfer at the heat exchanger tubes deteriorates as the deposit grows and builds up during operation so that mechanical cleaning is indispenisble.

With respect to mechanical cleaning methods one can distinguish between those methods which necessitate interruption of the operation and opening of the heat exchanger and those becoming effective during operation of the heat exchanger. The latter methods on the one hand comprise cleaning members fixedly mounted in the heat exchanger, and on the other hand systems in which the heat exchanger tubes are passed through by cleaning elements, as will be explained below.

Manual cleaning of heat exchangers is widely used. An essential drawback of this method is that operation of the heat exchanger, usually meaning the whole plant in which the heat exchanger is included, has to be shut down. The heat exchangers are opened up—to do this, they have to be arranged at a suitably accessible location and designed such that they are suitable to be periodically opened—and cleaned by conventional means such as using high pressure cleaning apparatus or using brushes/scrapers. Apart from the high cost involved, also due to the interruption of the operation of the heat exchanger and plant associated with it—a further drawback of this method is that while the deposit at the tube wall is removed, its formation and build-up leading to corresponding deterioration of heat transfer cannot be avoided from the outset. Thus, between cleaning intervals, the heat transfer deteriorates considerably in the course of the operation.

The mechanical cleaning methods effective in the running operation of the heat exchanger have to satisfy special requirements due to the very high operating temperatures, which are in excess of 120° C. and can easily reach ranges of about 400° C., as well as due to the chemical stresses arising from their use in an aggressive medium such as crude oil.

The use of cleaning elements fixedly mounted in the heat exchanger is based on the principle of mounting cleaning elements such as screw-shaped spring elements or the like at a receiving device at the intake of the heat exchanger, loosely arranged in the tubes and extending through the tubes. The cleaning elements are made of temperature and medium resistant materials. The receiving device facilitates axial movement of the cleaning elements in the tube. The shape and arrangement of the cleaning elements causes turbulences in the fluid medium delaying deposit formation. In addition, dirt particles or the like adhering to the inner wall of the tube are removed through the movement of the cleaning element, so that deposit formation is essentially prevented.

Such cleaning methods using fixedly mounted cleaning elements, however, have a drawback, in that the cleaning elements arranged in the tube itself, usually over its entire length, cause permanently increased friction losses in the fluid flow and thus increased energy consumption for the medium to be heated. Furthermore, the cleaning elements present obstacles in the free tube cross section so that dirt particles adhere to the cleaning elements and can lead the tubes being clogged.

Mechanical cleaning methods using cleaning bodies moveably arranged in the tube use roller-shaped cleaning brushes, reciprocating between the inlet and the outlet of the tube they are associated with and may thus remove a deposit from the tube inner wall. To do this, a basket is arranged at the inlet and the outlet of each tube. The basket at the outlet receives the brush after it has passed through the tube together with the fluid medium. The brush is then returned to the basked at the inlet side so that it is available for another cleaning pass through the tube.

For returning the brushes in the baskets at the inlet side, the heat exchanger must either be switched off, so that there will be an opportunity to return the brushes from the outlet side to the inlet side. Or the tubing system for the heat exchanger is arranged such that for returning the brushes the heat exchanger has the medium flow through in a reverse direction by switching over flow control elements causing the brushes caught in the baskets at the previous outlet side of the tube bundle of the heat exchanger to now pass through the tubes in the reverse direction with the medium flow and to be caught in the baskets at the previous inlet side, which is now the outlet side. The reversal of the flow direction of the fluid medium in the heat exchanger is carried out periodically. The installation of a system having a reversible fluid flow direction involves apparatus of considerable technical complexity so that the cost involved with this system is very high. If the receiving means get detached and lost, the associated brush also gets lost, and the tube will no longer be cleaned, without this being detectable from the outside. Lost receiving devices and brushes are dangerous obstacles since they can adversely affect the free passage of the medium. Damaged or worn-out cleaning bodies may only be exchanged by switching off the plant and opening the heat exchanger. There is no other means of detecting wear and tear of the cleaning bodies. This means that the cleaning brushes do not thoroughly clean the tubes and they cannot generally be used optimally since the cleaning brushes are exchanged either too soon or too late.

Departing from a system of the type mentioned above, the object of the invention is therefore to provide a system for cleaning tubes of heat exchangers for fluid media, in particular crude oil, at a temperature of in excess of 120° C., in which cleaning the inner wall of the heat exchanger tube is carried out during the operation of the heat exchanger. The system is intended to fulfill the requirements of a fluid medium having high temperatures and generally deemed to be chemically aggressive.

To solve the above object the present invention provides that a cleaning system of the above type is characterized in that cleaning bodies that are resistant to temperatures (in excess of 120° C.) and are able to withstand aggressive fluid media such as crude oil and having outer dimensions when cleaning equal to the inner diameter of the tube to be cleaned and having an outer contact surface suitable for cleansing off deposits from a tube inner wall, pass through the tube due to the pressure of the fluid medium and are pressed with their contact surface against the inner wall of the tube by a contact pressure and in that during a pass of the cleaning bodies, deposits adhering to the inner wall of the tube are caught and detached by the contact surface of the cleaning bodies as well as carried along by the fluid medium and/or the cleaning body and carried out of the tube.

The system according to the invention allows for cleaning the tubes of heat exchangers during the running operation of the heat exchanger and the remaining components of the plant associated with the heat exchanger. The cleaning bodies provided to do this are resistant to high temperatures and aggressive fluid media, such as crude oil, due to a suitable choice of materials and a suitable structure. They freely pass through the tube to be cleaned due to the pressure of the fluid medium entering from the inlet of the tube and, after passing through the tube, leaving it again at the outlet. The result is a thorough cleansing of the inner wall of the tube, as the contact surface of the cleaning body, when it passes through the tube, contacts the entire surface of the inner wall of the tube and is pressed against the inner wall of the tube due to a contact pressure. The contact surface of the cleaning body is formed in such a way that it catches and detaches deposits such as dirt particles or the like adhering to the inner wall of the tube so that these are carried along by the fluid medium and/or the cleaning body itself and may be carried out of the tube. In this way it is impossible for a deposit in the sense of a long term build-up of dirt particles to form on the inner wall of the tube. Caking on the inside of the tube is also avoided. The heat transfer at the tubes of the heat exchanger, and therefore its efficiency, remain uniform and are not degraded. By continuous cleaning during the operation of the heat exchanger, conditions remain constant during the entire operating time. The necessity to shut down and open the heat exchanger for tube cleaning—as in the prior art—is eliminated. It is not necessary to add additives to the fluid medium. At the inlet and outlet sides of the heat exchanger, there is no need for expensive apparatus for introducing the cleaning bodies in the tubes and for catching them at the end of the tube.

According to a preferred embodiment of the invention, the cleaning bodies are collected after passing through the tubes and inserted in the inlet openings of the tubes for a further cleaning pass through the tubes, as needed. According to the particular circumstances, there may be a need for an immediate return of the cleaning bodies to the inlet side of the heat exchanger, or only a later point in time. It is essential that the cleaning bodies are not directed towards individual receiving devices at the outlet side, but that the cleaning bodies are collected and are collectively returned to the inlet side, in any case using a common path and not requiring costly recycling actions or measures. Preferably, the cleaning bodies are recycled continuously or discontinuously, namely they are collected in a catching device after having passed through the tubes and either returned directly to the inlet side of the tubes for another pass or first collected in a receiving means, wherein the tube cleaning is interrupted and only resumed after a predetermined period of time has elapsed or depending on the amount of dirt present in the tubes or on other parameters. This system variant is essential since it allows for automatic continuous or discontinuous recycling of the cleaning bodies so that cleaning of the inner wall of the tubes can generally be carried out very easily and efficiently without the need for substantial structural requirements.

A preferred embodiment of the invention provides, by a recycling conduit for the cleaning bodies, for a catching device downstream of the outlet side of the heat exchanger, such as a fixed or moveable sieve or filter for catching the cleaning bodies from the fluid flow. Stationary catching devices, such as filters or fixed sieves usually span the whole of the cross section of the outlet conduits on the outlet side of the heat exchanger. Moveable sieves may be switched between a neutral position in which they let pass the entire fluid stream including all component materials, and a collecting position in which they span the entire cross section of the outlet conduit of the medium to catch the cleaning body.

Downstream of each of the catching devices there is a lock for inserting and removing the cleaning bodies. In discontinuous operation, the lock may also serve for intermediate storage of the cleaning bodies during an interruption of the tube cleaning.

Overall, a system for-cleaning tubes of heat exchangers for fluid media such as crude oil having a temperature in excess of 120° C. and having considerable aggressive chemical properties is provided, which is essentially different from the known systems discussed above and which for the first time allows or enables a sustainable cleaning of the tubes also for these media, without the need for considerable structural requirements. In particular, the system according to the present invention helps to avoid a situation where the operation of the heat exchanger and the components dependent on the operation of the heat exchanger of an entire plant, has to be interrupted and the heat exchanger has to be opened for tube cleaning. This is the first time that due to the invention there is a system for such media in which the cleaning bodies can be tested for usability when they are returned from the outlet side, by having the cleaning bodies pass through a corresponding testing apparatus.

A further part of the invention is a cleaning body for systems of the above described type, namely for systems for cleaning tubes of heat exchangers flown through by fluid media, in particular crude oil, having a temperature in excess of 120° C. According to the present invention, a cleaning body is formed in such a way that, for cleaning a tube, deposits such as dirt particles or the like adhering to the inner wall thereof are detached by the cleaning body through a cleansing action and carried out of the tube, while the cleaning body passes through the tube. Preferred embodiments of the cleaning body according to the invention enabling the inner wall of the tubes of the heat exchanger to be kept clean or be cleaned, are explained in the following.

A particularly preferred embodiment of the cleaning body is characterized in that the cleaning body being resistant to temperatures (in excess of 120° C.) and being able to withstand aggressive fluid media such as crude oil and having outer dimensions when cleaning the tube equal to the inner diameter of the tube to be cleaned and the cleaning body having an outer contact surface suitable for cleansing off deposits from a tube inner wall, pass through the tube due to the pressure of the fluid medium and is pressed with its contact surface against the inner wall of the tube due to a contact pressure and in that during a pass of the cleaning body, deposits adhering to the inner wall of the tube are caught and detached by the contact surface of the cleaning body as well as carried along by the fluid medium and/or the cleaning body and carried out of the tube.

Using this cleaning body, for the first time, there is provided a relatively simply cleaning means leaving the structure and the tubing system of the heat exchanger for the fluid medium, namely in particular for the crude oil flow, essentially unchanged. Compared to the prior art, there are no structural requirements. The operation of the plant is enabled without the necessity of interruptions for opening up the heat exchanger to clean the tubes. Consequently, the overall effect is a high degree of technological and economic advantages over and above previous cleaning bodies known for tube cleaning with heat exchangers for hot (in excess of 120° C.) and also aggressive fluid media. Cleaning bodies of this type according to the present invention can be used in the above explained inventive cleaning systems, and therefore the advantages already set out for these systems also apply to the inventive cleaning bodies themselves.

The cleaning body according to the invention is preferably formed to be an essentially spherical, resilient rolling body having a cleaning surface, the entire surface of the cleaning body forming the contact surface for cleansing off deposits from the inner wall of the tube. This form and embodiment of the cleaning body of the present invention has substantial advantages. To start with, due to its spherical or ball shape, the body need not be inserted in the tube inlet of the tube to be cleaned in a particular orientation, but the cleaning body, after insertion in the tube, automatically adapts to the free inner cross section of the tube in any orientation without particular measures being required therefor. Since the entire surface of the cleaning body forms a contact surface suitable for cleansing off deposits, wherein the contact surface engages the inner wall of the tube, a high cleaning potential is provided due to the spherical shape. Due to its resilience the cleaning body can adapt to any possible practical variation in the form of the free cross section of the tube to be cleaned, for example when there is caking as a consequence of an unexpected transitory amount of dirt present in the fluid medium.

Preferably the outer diameter of the cleaning body in its uncompressed state, that is before insertion of the cleaning body in the tube, is larger than the inner diameter of the tube, and the outer diameter of the cleaning body adapts to the inner diameter of the tube when the cleaning body is inserted at the inlet opening of the tube and where it is resiliently compressed. In this embodiment of the cleaning body, the contact pressure with which the contact surface of the cleaning body engages the inner wall of the tube, is generated by the resilient structure of the cleaning body. To achieve this the cleaning body in its uncompressed state is formed with a greater outer diameter than that corresponding to the inner diameter of the tube.

Cleaning bodies according to the present invention may be used in a variety of differently operated cleaning systems. It is therefore possible to use cleaning bodies of the invention for systems in which cleaning bodies practically reciprocate in a tube to be cleaned through the reversal of the fluid flow direction. Due to the provision of a reversable tubing system for the fluid medium, a relatively high amount of structural requirements is needed, as has been explained above. Such a cleaning system, however, is very much simplified by the use of the cleaning bodies of the present invention since, as explained above, the use of the cleaning body according to the invention is not dependent on any orientation. This has the advantage that not every cleaning body has to have its own receiving basket on either end of the tube to be cleaned, by which the cleaning body at the inlet and outlet sides always has to be oriented with respect to the tube for it to be insertable in the tube for passing through the same. According to the invention, the cleaning bodies may be caught as a batch, i.e. as a plurality, after a cleaning pass through the tube at its outlet side and inserted again into the tubes in a suitable way, either by fluid flow reversal at the previous outlet side or by returning the cleaning bodies as a batch to the previous inlet side, which will then always be the inlet side.

The cleaning bodies according to the invention are particularly advantageously used in systems in which they are continuously or discontinuously recycled. In order to avoid undue repetitions, reference is made to the inventive systems explained above.

According to a preferred embodiment, the cleaning body comprises a buoyancy element on its inside and a cleaning element on its outside. The buoyancy element defines or influences the position or the path of the cleaning body in the fluid medium flow, while the cleaning element provides the function of cleaning the tube. The buoyancy element is intended to achieve that the cleaning body is suspended in the fluid medium flow, so that the cleaning bodies are evenly distributed, especially at the inlet side of the heat exchanger, i.e. adjacent to the tube plate, so that the tubes are cleaned with about equal frequency. Thus, when designing the buoyancy element, it has to be kept in mind that an overall density of the cleaning body is achieved corresponding to the density of the processing medium, so that the cleaning body floats or is suspended. When forming the cleaning element, it is to be kept in mind that the spherical or ball shaped contact surface is primarily suitable for cleansing off deposits or dirt particles or the like deposited on the inner wall of the tube and is designed to be correspondingly abrasive.

With respect to the function of the buoyancy element it is useful for the buoyancy element to be arranged at the center of the cleaning body and to be made of one or more pressure resistant hollow bodies, or made pressure resistant, such as of metal, or of bodies having a low density, such as of metal foam. The pressure resistance requirements are largely dependent on the relatively high system pressure, which is present for example in systems for heating crude oil.

The contact surface of the cleaning element must primarily have an abrasive effect, so that deposits can be cleansed off from the inner wall of the tube. To achieve this the cleaning element may be made of metal lamellae, knitted metal, braided metal, metal foil or the like, i.e. materials that are heat resistant and resistant to aggressive media and having edges suitable for cleansing off residues from the inner wall of the tube. The cleaning element should usefully also be formed to be resilient so that a corresponding contact pressure is exerted between the contact surface and the inner wall of the tube when the cleaning body enters the tube. The directly effective section of the spherical or ball-shaped contact surface due to the resilient properties of the cleaning element may correspond to a narrow strip-like flattening circularly extending around the cleaning body and engaging the inner wall of the tube.

It is expected to be quite rare that a resilient binder material such as metal foam carries the cleaning element and will alone impart the necessary resilient behavior of the cleaning body. More likely the necessary elasticity will be generated by a combination of the binding material and the cleaning element. However, the cleaning element can be partially or wholly embedded in the binding material.

In case that the deposits cleansed off by the cleaning body from the inner wall of the tube stick fast to the contact surface of the cleaning body and the contact surface is not detached by the fluid medium itself from the contact surface, cleaning of the contact surface of the cleaning bodies may be carried out before renewed insertion at the inlet side of the heat exchanger, such as by high pressure jet cleaning of the contact surface of the cleaning body, and/or by mechanical means such as brushes or the like. Checking of the cleaning bodies with respect to wear or damage or the like is always possible during the return of the cleaning bodies from the outlet side of the heat exchanger to the inlet side.

According to an alternative embodiment of the cleaning body of the present invention it is provided that the cleaning body comprises a front—as seen in the fluid flow direction of the fluid medium in the tube—buoyancy element and a cleaning element attached to its rear side. In this embodiment the functions "buoyancy" and "cleaning" are distributed to two separate body portions, even if the two body portions are joined to form a cleaning body. When designing the buoyancy element the weight of the cleaning element has also be taken into consideration. The buoyancy element is first to enter the tube to be cleaned and takes along the cleaning element attached to its rear side.

Conveniently, the buoyancy element has a ball-shaped form and takes the function of a float formed of one or more cavities or formed as a corresponding porous structure. The diameter of the buoyancy element is suitably smaller than the inner diameter of the tube such that the buoyancy element may easily enter the tube inlet and pass through the tube as freely as possible.

The cleaning element of the present cleaning body is preferably formed to be leaf or disk shaped as well as circular and carries a crown of resilient lamellae, the crown contacting the inner wall of the tube as a contact surface. Consequently the diameter of the crown of lamellae is greater in its free state than in the tube when the rim of lamellae is resiliently compressed to the tube inner diameter thus creating the necessary contact pressure. When the cleaning body is within the tube, the pressure of the fluid medium mainly acts on the cleaning element in order to push the cleaning body through the tube together with the fluid medium. Depending on the design of the cleaning element which can for example also have an outer crown in the form of a wire brush forming the cleansing contact surface, the front buoyancy element may also serve as a thrust body, such as by making the circular gap between the outside of the buoyancy element and the inner wall of the tube relatively small.

An essential preferred embodiment of the cleaning body according to the present invention is provided by designing the combination of the buoyancy element and the cleaning element—irrespective of whether the cleaning body is comprised of one or two portions—in its overall density in such a way that the overall density corresponds to the density of the fluid medium and the cleaning body is therefore suspended in the fluid medium.

It is further preferred that the material of the cleaning element and the material of the binding material, if any, and the material of the buoyancy element is temperature resistant (120° C. or more) as well as resistant to aggressive media such as crude oil, and is preferably made of metal.

Example embodiments of the invention are more fully explained with reference to the drawings, in which:

FIG. 1 is a diagrammatic view of an exemplary heat exchanger plant having a system for cleaning tubes of heat exchangers in which the tubes are passed through by cleaning bodies and the cleaning bodies are recycled in the plant;

FIG. 1*a* is a diagrammatic view of a further exemplary heat exchanger plant as in FIG. 1, however having an alternative design of a lock used for recycling the cleaning bodies;

Figure 1:
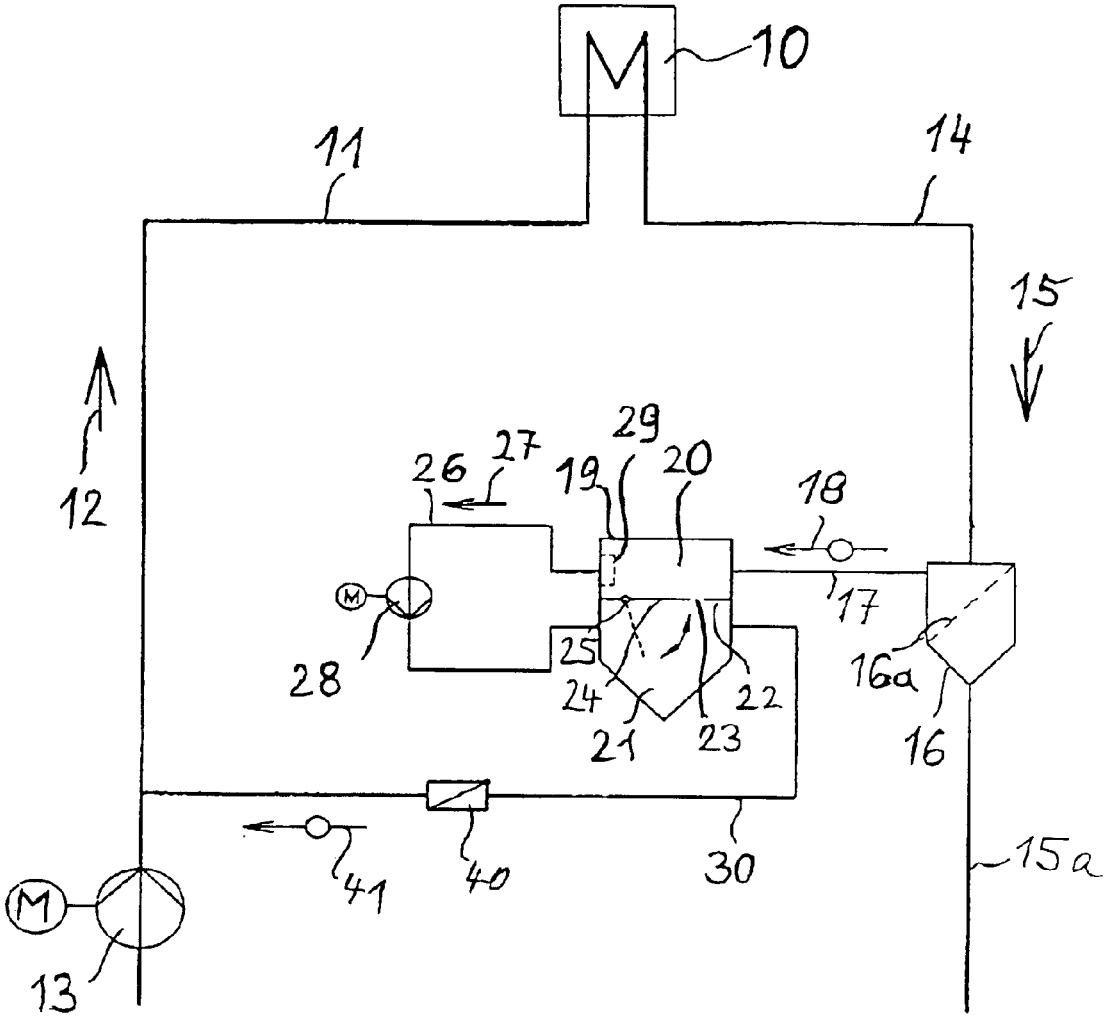

The strictly diagrammatically plant shown in FIG. 1 as an example embodiment serves for heating a crude oil flow in a heat exchanger 10, to which the crude oil is fed through a supply conduit 11 in the direction of arrow 12 supported by a pump 13. The heat exchanger 10 comprises a bundle of tubes (not shown) in the usual way in which the crude oil is heated by process heat acting on the crude oil through the tube wall, while the crude oil is passing through the tubes. Downstream of the heat exchanger 10 the crude oil is extracted through conduit 14 in the direction of arrow 15 and fed to the next processing stage. For example the temperature of the crude oil fed through the plant can be in the range of between 100° C. And 400° C.

For cleaning the tubes of the heat exchanger 10 during the running operation of the heat exchanger 10 and the remaining components of the plant, cleaning bodies are provided which while not shown in FIG. 1 are more fully explained with reference to the remaining drawing figures. The cleaning bodies are distributed at the tube plate of the heat exchanger 10 in such a way that at least one cleaning body enters into each inlet of a tube. Each cleaning body freely passes through the tube to be cleaned due to the pressure of the crude oil flow by entering at the inlet of the tube and leaving the tube at its outlet after having passed through it. This results in a thorough cleaning of the inner wall of the tube. Any deposits such as dirt particles or the like adhering to the inner wall of the tube will be abraded by the cleaning body and carried out of the tube together with the crude oil flow. In order to avoid undue repetition, reference is made to the description of the system according to the present invention as well as to the cleaning bodies according to the present invention in the introductory portion of the present specification.

The representation of FIG. 1 primarily shows a preferred embodiment of the system according to the invention, wherein the cleaning bodies are continuously or discontinuously recycled. This means that after passing through the tubes, the cleaning bodies are first retrieved from the crude oil flow of the conduit 14 by a catching device 16 and diverted through a conduit 17 in the direction of arrow 18, while the crude oil flow leaves the plant without cleaning bodies via an exit conduit 15*a*. In the catching device 16, a filter can be provided as a stationary catching device spanning the entire cross-section of the catching device 16. However, also moveable or fixed sieves (schematically shown as a broken line 16*a* in FIG. 1) can be used as a catching device 16. The sieves are switcheable between a neutral position in which they let pass the whole of the crude oil flow, and a collecting position in which they span the whole of the cross section of the catching device 16 and remove the cleaning bodies from the crude oil flow.

In the case of a continuous cleaning operation of the tubes of the heat exchanger 10 the cleaning bodies are directly recycled from the conduit 17 to the supply conduit 11 (not shown).

In the case of discontinuous recycling, or introduction into the supply conduit 11, of the cleaning bodies—either periodically after a predetermined period of time has elapsed or depending on the amount of dirt present in the tubes or on other parameters—the cleaning bodies are fed via conduit 17 to a collecting device, i.e. a lock 19, in which they are collected and, at a predetermined time, reintroduced into the supply conduit 11 via the conduit 30 and a check valve 40 in the direction of arrow 41. To do this the lock 19 has been divided into an upper chamber 20 and a lower chamber 21 separated from each other by a bottom wall 22. In the bottom wall, there is an opening 23 closed by a flap 24 pivotable around axis 25, while the cleaning bodies are collected in the upper chamber 20. In a bypass 26 extending from the upper chamber 20 and coupled at its other end in a particular position to the lower chamber 21, a pump 28 is provided feeding the crude oil coming from conduit 17 through a wire basket 29 or the like, which does not allow cleaning bodies to pass, from the upper chamber 20 to the lower chamber 21 in such a way that the flow entering it, as indicated by the double arrow, holds the flap 24 in the closed position of the opening 23 as long as the cleaning bodies are collected in the upper chamber 20. When the pump 28 is switched off, the flap 24 sinks to the open position indicated in the drawing by a broken line, so that the cleaning bodies are allowed to pass from the upper chamber 20 to the lower chamber 21.

At the beginning of a new cleaning cycle the flap 24 is in the open position. The cleaning bodies are located in the lower chamber 21. As soon as the drive of pump 28 is energized, the flap 24 is pivoted to its upper, closed position due to the crude oil flow from the bypass conduit 26 directed against the flap 24.

The cleaning bodies are carried by the crude oil flow from the bypass conduit 26 into the conduit 30, in which the check valve 40 is opened at the start of the cleaning cycle by the pressure of the fluid medium, and carried from there to the inlet conduit 11. Cleaning bodies collected by the catching device 16 during such cleaning cycle are returned via the conduit 17 to the upper chamber 20, while the opening 23 is held closed by the flap 24. At the end of the cleaning cycle, the drive of the pump 28 is deenergized. The crude oil flow from the bypass conduit 26 ceases so that the flap 24 is pivoted back from its closed position into its opened position by the action of gravity. The check valve 40 prevents a return flow of the medium. The cleaning bodies descend from the upper chamber 20 through the opening 23 to the lower chamber 21. They stay there waiting for the next cleaning cycle.

The mode of operation described with reference to FIG. 1 is used with sinking cleaning bodies, i.e. cleaning bodies having a greater density than the operating medium (e.g. crude oil). For cleaning bodies having a lower density, i.e. cleaning bodies which rise in the operating medium, also perhaps crude oil, an alternative design and operating mode of the lock has to be provided. An example embodiment of such a lock can be seen from FIG. 1*a* in a diagrammatical view. The following description is essentially limited to the structure and operation of the lock.

This lock 19 similarly to lock 19 of FIG. 1 is divided into upper and lower chambers 20, 21, separated by a bottom wall 22. An opening 23 is provided in the bottom wall 22, operable to be closed by a flap 24 pivotable around an axis 25, while the cleaning bodies are being collected in the lower chamber 21. In a bypass 26 extending from the lower chamber 21 and being coupled at its other end in a particular position to the upper chamber 20, a pump 28 is provided as in the embodiment mentioned above, feeding crude oil coming from conduit 17 through a wire basket 29 or the like, which does not pass any cleaning bodies, from the lower chamber 21 to the upper chamber 20 in such a way that the flow entering it, as indicated by the double arrow, holds the flap 24 in the closed position of opening 23 against the spring force of a spring 24*a*, as long as the cleaning bodies are being collected in the lower chamber 21. As soon as pump 28 is deenergized, the flap 24 is opened by the spring force to the open position indicated with broken lines in the drawing figure, so that the cleaning bodies rise from the lower chamber 21 to the upper chamber 20.

At the start of each new cleaning cycle, the flap 24 is in the open position. The cleaning bodies are in the upper chamber 20. As soon as the operation of the pump 28 is started, the flap 24 is pivoted downwards to the closed position against the spring force due to the effect of the crude oil flow coming from the bypass conduit 26 and directed against the flap 24. The cleaning bodies are carried by the crude oil flow from the bypass conduit 26 into conduit 30 in which the check valve 40 is opened at the start of the cleaning cycle by the pressure of the fluid medium, and from there back to the inlet conduit 11. Cleaning bodies collected by the catching device 16 during such a cleaning cycle are returned through the conduit 17 to the lower chamber 21 and collected there because the opening 23 is held closed by the flap 24. At the end of the cleaning cycle, the drive of the pump 28 is deenergized. The crude oil flow from the bypass conduit 26 ceases, so that the flap 24 is pivoted by the spring force from the closed position back to the open position. The cleaning bodies rise from the lower chamber 21 through the opening 23 to the upper chamber 20. They stay there waiting for the next cleaning cycle.

Six different example embodiments of cleaning bodies will be described in the following with reference to FIGS. 2 to 8, wherein in order to avoid undue repetition, at the same time, reference is made to the introductory portion of the present specification.

Figure 2:
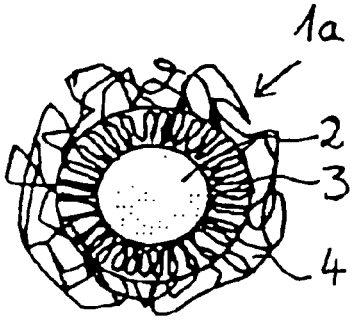
FIG. 2 is a cross-sectional diagrammatic view of a first exemplary embodiment of a cleaning body.

In the first example embodiment of FIG. 2, a cleaning body 1*a* is comprised of a central, spherical hollow body as a buoyancy element 2 having an outer abrasive cleaning element 4 made of knitted metal fixedly secured on the buoyancy element 2 by means of an intermediate metallic resilient medium 3. The connections of the component parts is done by conventional methods of connecting such as welding, glueing, soldering or the like. The buoyancy element 2 in this case is relatively small compared to the cleaning element 4, whose knitted metal as well as the structure of the resilient medium 3 is relatively loose so that the buoyancy element 2 with reference to the desired overall density of the cleaning body 1*a*, has to counterbalance only a relatively light weight. The overall specific gravity of the cleaning body 1*a* is principally to be substantially adapted to the density of the medium, unless there are circumstances which allow or ever require a difference. All parts of the cleaning body 1*a* are made of metal—excepting the adhesive agent, which can also be a high-temperature resistant plastics material. The knitted metal of the cleaning element 4 is made of poly-edged, in particular rectangular, stainless wire or strip steel material, the cleaning element 4 in combination with the resilient medium 3 providing the cleaning body 1*a* with the necessary resilient property. In order to achieve this, the resilient medium 3 is of resilient wound metal lamellae or a corresponding resilient metal mesh, each being attached, in the form of a hollow sphere, on the buoyancy element 2—a pressure resistant hollow metal sphere. Regardless of which metal or other material is selected for the component parts of the cleaning body 1*a*, the component parts are designed to withstand processing temperatures of up to 400° C. And withstand an aggressive process medium, such as crude oil. These prerequisites also apply to the further example embodiments described below. For the resilient medium 3, for example also a tube-like mat of knitted spring steel wire may be used, e.g. the tube being able to be soldered at both ends for closing and fixing purposes. The elasticity of this layer is essential, so that the cleaning body 1*a* may easily adapt to the inner diameter of the tube to be cleaned while still exerting a pressure on the inner wall of the tube, when passing through the tube, sufficient for cleansing off dirt from the inner wall of the tube. The knitted metal or rib mesh of the cleaning element 4 is secured on the resilient medium 3 by soldering or any other conventional securing method, as mentioned above. The blank thus created is finally pressed into a spherical form. The spherical hollow body of the buoyancy element 2 for example is formed of two deep-drawn metal cup halves.

Figure 3:
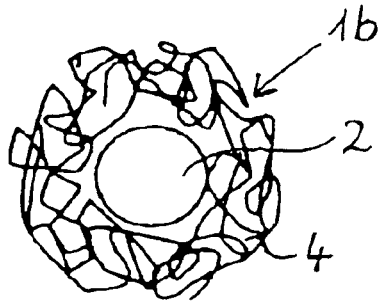
FIG. 3 is a cross-sectional diagrammatic view of a second exemplary embodiment of a cleaning body.

With respect to the second example embodiment according to FIG. 3, the cleaning body 1*b* is formed from a pressure resistant hollow metal sphere as a buoyancy element 2 having secured directly on it an essentially spherically shaped cleaning element 4 of metal mesh or rib mesh of spring steel. The securing on the buoyancy element 2 and a stabilisation of the resilient material of the cleaning element 4 is done e.g. by soldering. Since the cleaning element 4 is in this case very resilient, no additional resilient medium is need as in the first example embodiment, and also in this case, the buoyancy element 2 is relatively small when compared to the cleaning element 4.

Figure 4:
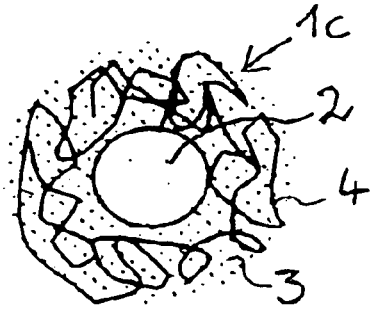
FIG. 4 is a cross-sectional diagrammatic view of a third exemplary embodiment of a cleaning body.

With reference to the third example embodiment according to FIG. 4, the cleaning element 4 is secured on the spherical buoyancy element 2, wherein the cleaning element 4 may consist of knitted metal or metal mesh as in the previous example embodiments, may be both secured directly on the buoyancy element 2 e.g. by soldering, and additionally may be wholly or partially embedded in the resilient medium 3, which may comprise a temperature resistant elastomeric material or a resilient metal foam. In this case the cleaning medium 4 and the elastomeric material are both brought into the desired spherical shape, if desired in a single processing step, and the elastomeric material is formed into the desired spherical shape in an injection mold, and the elastomeric material is injected into the rib mesh or knitted metal structure. This manufacturing method is particularly easy to carry out. As in all previous example embodiments, welding, glueing, soldering or the like is used here as a securing method.

Figure 5:
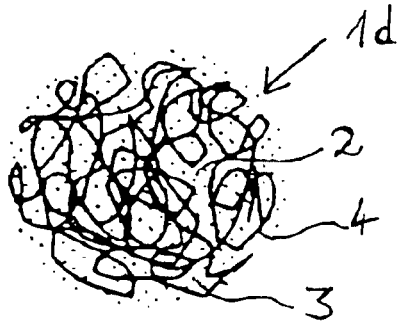
FIG. 5 is diagrammatic view of a fourth exemplary embodiment of a cleaning body.

With reference to the fourth example embodiment according to FIG. 5, the cleaning body 1*d* does not include a separate buoyancy body 2, but a cleaning element 4 consisting of metal lamellae, knitted metal, metal mesh or rib mesh, is directly embedded in a resilient medium 3 consisting of a resilient metal foam or a temperature resistant elastomeric material and simultaneously acting as a buoyancy element 2.

Figure 6:
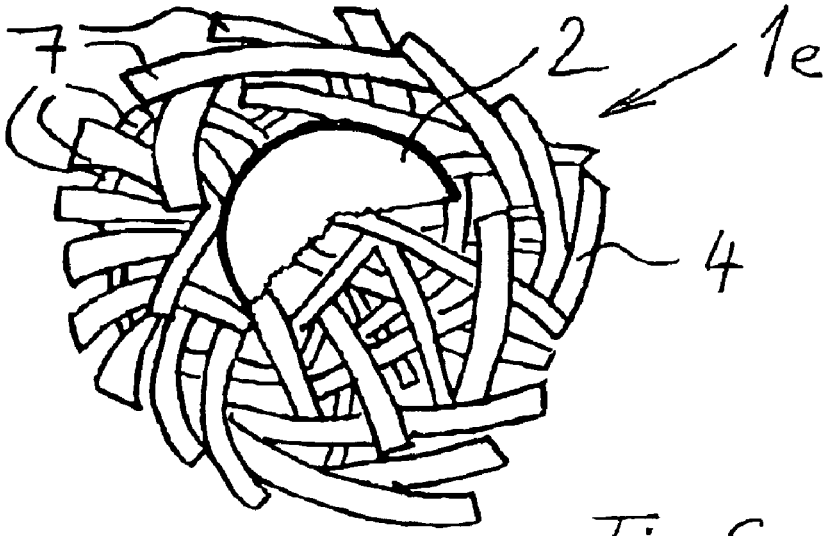
FIG. 6 is partial sectional view of a fifth exemplary embodiment of a cleaning body.
Figure 7:
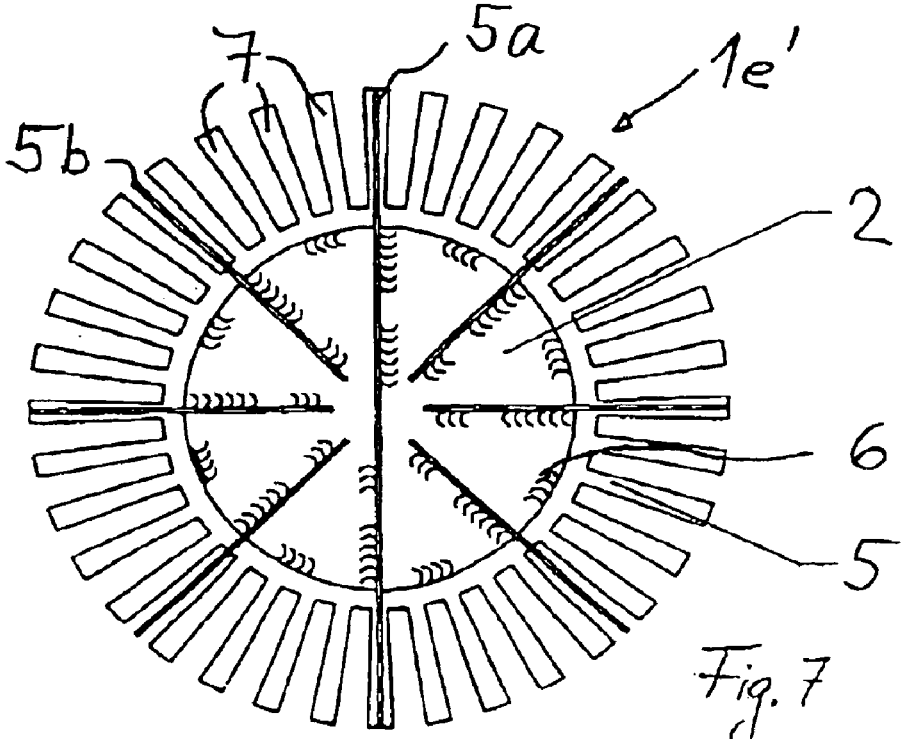
FIG. 7 is a view of a blank of the exemplary embodiment of a cleaning body according to FIG. 6.

With reference to the fifth example embodiment of a cleaning body 1*e* according to FIG. 6, the buoyancy element 2 is, again, substantially smaller than the cleaning element 4, and the present cleaning body 1*e* is manufactured from the blank 1*e*' shown in FIG. 7. First, a ronde 5 of spring steel, slotted on the outside as shown in FIG. 7, is soldered onto the metal sphere of the buoyancy element 2, such as indicated at 6. Subsequently, two ronde halves 5*a* are soldered onto the buoyancy element 2 at an angle of 90° with respect to the ronde 5, whereafter semi-circular or quadrant-shaped ronde segments 5*b* are arranged and soldered in the symmetrical manner evident from FIG. 7 in the remaining intermediate spaces on the buoyancy element 2. Then the external radially extending webs 7 of the ronde 5 as well as the ronde halves 5*a* and the ronde segments 5*b* are deformed in such a way that the spherical form shown in FIG. 6 of the cleaning body 1*e* is created, having sharp-edged webs or lamellae 7 on the outside and having an overall elasticity so that they are able to adapt to the inner diameter of the tube to be cleaned and still exert sufficient pressure for cleansing off dirt from the inner wall of the tube.

In all of the previously described example embodiments of the cleaning bodies, the weight is selected such that the overall weight of the cleaning body essentially corresponds to the specific gravity of the medium, so that the cleaning bodies may be suspended in the fluid medium flow and in this way primarily distribute evenly at the tube plate of the heat exchanger when the cleaning bodies are to be fed into the tubes to be cleaned. Possible exceptions have been pointed out in the description of the first example embodiment.

For cleaning the tubes, e.g. of the heat exchanger 10 of the plant shown in FIG. 1, the cleaning bodies 1*a*–1*e* are fed via the supply conduit 11 for the crude oil flow on the inlet side of the heat exchanger 10 and thus pass to the area of the tube plate of the heat exchanger 10. When the crude oil flow is distributed to the individual tubes of the heat exchanger 10, the cleaning bodies 1*a*–1*e* are easily carried along so that they enter the inlet of one of the tubes to be cleaned of the heat exchanger 10. The cleaning bodies 1*a*–1*e* are resiliently compressed in the process until they have reached the inner diameter of the tube. Thus a contact pressure is generated which is necessary for pressing the contact surface, namely the outer surface of the cleaning elements 4 of the cleaning bodies 1*a*–1*e*, to the inner walls of the tubes to be cleaned. Due to the action of the contact pressure, deposits of dirt particles or the like are cleansed off the inner wall of the tube when the cleaning bodies 1*a*–1*e* pass through the tubes, the fluid pressure of the fluid medium acting as a thrust force on the cleaning bodies 1*a*–1*e*.

Figure 8:
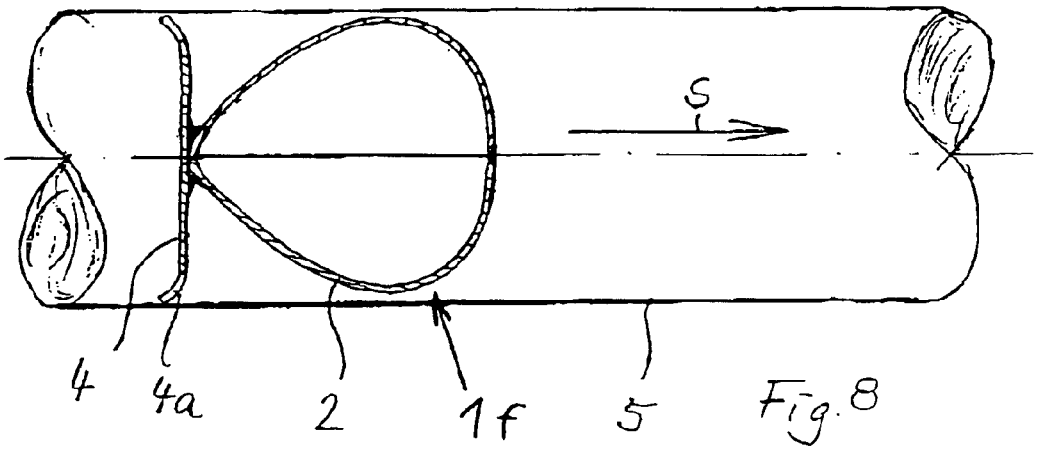
FIG. 8 is a sectional view of a sixth exemplary embodiment of a cleaning body, the cleaning body having a two-part form.

Unlike the previously described example embodiments, with reference to the sixth example embodiment shown in FIG. 8, the cleaning body 1*f* is formed in two parts. To a front—as seen in the fluid flow direction S—portion, such as pear shaped or ball shaped, preferably spherical hollow metal body as a buoyancy element 2, a circular as well as leaf shaped disk of spring steel having a thickness of about 0.1 to 0.5 mm is centrally secured, as shown, as a cleaning element 4 such as by welding or soldering. The required strength or stability determines the minimum thickness of said disk, having a diameter in excess of the inner diameter of the tube 5 to be cleaned. At the outer rim of the cleaning element 4 there is a crown of resilient lamellae 4*a* which, at the insertion of the cleaning element 4 into the tube 5 to be cleaned, are resiliently flexed so that the outer diameter of the cleaning element 4 adapts to the inner diameter of the tube, and the lamellae 4*a* are pressed to the inner wall of tube 5 with the required contact pressure. In this way, the lamellae 4*a* of the cleaning element 4 are able to cleanse off deposits of dirt particles or the like from the inner wall of the tube 5, when the cleaning body 1*f* passes through the tube by the action of the fluid flow medium. As in the previously described example embodiments, the overall specific weight of the cleaning body is about 0.8 g/cm$^3$. With respect to the selection of the metal and the connection between the buoyancy element 2 and the cleaning element 4, the cleaning body 1*f* is designed to withstand operating temperatures of about 400° C. as well as to withstand the chemically aggressive properties of crude oil, forming the fluid flow medium.

For the purposes of practical implementation it has been found that the cleaning body 1*f* in the two-part form, such as shown in FIG. 8, performs an automatic alignment in the area of the tube plate of the heat exchanger when the cleaning bodies 1*f* are to be fed into the tube to be cleaned, at the latest before the inlet of the tubes to be cleaned in such a way that the buoyancy element 2 always enters the inlet of the tube 5 first, and the cleaning element 4 follows the buoyancy element 2, so that the position shown in FIG. 8 of the cleaning body 1*f* in the tube 5 is automatically achieved. It is also quite unproblematical to remove the cleaning bodies 1*f* in the catching device 16 from the crude oil flow of conduit 14 and divert them to the conduit 17 as well as either feed them directly into the supply conduit 11 for continuous cleaning of the tubes of the heat exchanger such as heat exchanger 10 of the plant shown in FIG. 1, or transport them via the conduit 17 in the lock 19 provided as a collecting device and return them from there to the supply conduit 11 at the appropriate time. The disk of the cleaning element 4 can have a greater thickness near its center than near its periphery. This is because the required resilience for the purposes of adaptation to the inner diameter of the tube 5 must be afforded exclusively by the outer rim of the cleaning element 4. Moreover, the hollow body or the sphere of the buoyancy element 2 can be made substantially smaller than in the example shown in FIG. 8. It is also pointed out that with respect to cleaning body 1*f*, blocking of the tube 5 needed for creating the required pressure difference is solely effected by the disk of the cleaning element 4. This feature is also important for automatically aligning the cleaning body 1*f*.

Figure 1A:
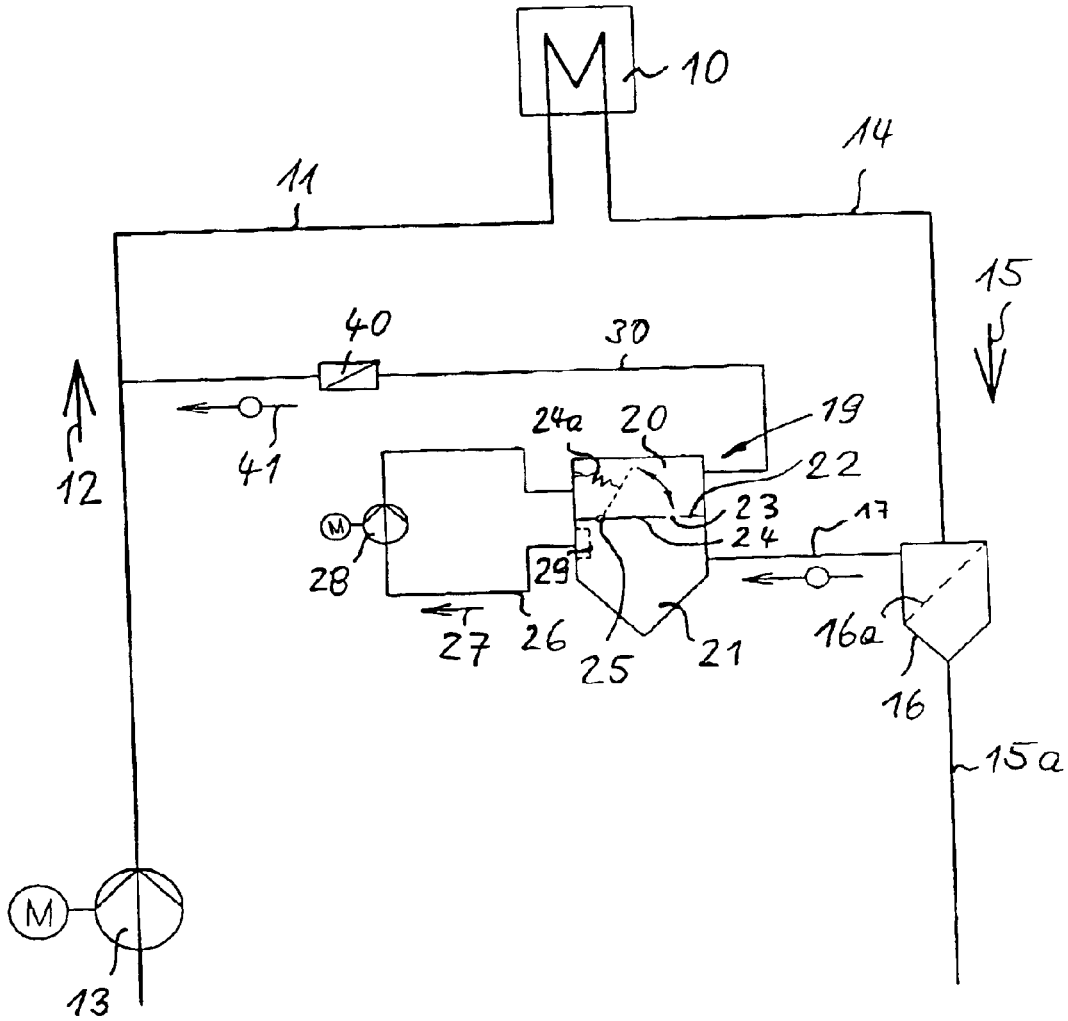

The representations of FIGS. 1 and 1*a* and the operating modes described are exclusively intended to be exemplary embodiments to which the invention is in no way limited.

In particular, it should be pointed out that the inventive cleaning bodies can not only be used in plants for processing crude oil but also in to other plants being operated at high temperatures in excess of 120° C. Thus the cleaning bodies are also useful for cleaning evaporator tubes in desalination plants and other high temperature applications. Using the cleaning bodies for special applications, such as with aggressive media in the chemical industry is also contemplated.

Finally, it should be pointed out that cleaning bodies according to the present invention can also be used in tubing systems operated at temperatures below 120° C. The operating temperature in excess of 120° C. is mentioned so frequently in the above description as well as in the appended claims because the cleaning bodies according to the present invention are intended to be suitable primarily for heat exchangers, in which crude oil circulates as a medium at a high temperature, without the use of the cleaning bodies of the present invention being limited to such application.

What is claimed is:

1. System for cleaning tubes of heat exchangers through which a fluid medium flows, comprising cleaning bodies resistant to temperatures greater than 120° C. and able to withstand exposure to said fluid medium, said cleaning bodies having an outer dimension substantially equal to an inner diameter of an inner wall of said tubes, and having an outer contact surface adapted to remove deposits from said inner wall of said tubes, said bodies being driven through said tubes by said fluid medium whereby said deposits are removed from said inner wall and carried from said tubes by at least one of said cleaning bodies and said fluid medium, wherein said cleaning bodies comprise an inner buoyancy element and an outer cleaning element, and wherein said cleaning element forms a contact surface and is a material selected from the group consisting of metal lamellae, knitted metal, metal mesh, and metal foil, and wherein said material is attached to at least one of said buoyancy element and an intermediate element.

2. System according to claim 1, further comprising means for collecting said cleaning bodies from said tubes and reintroducing said cleaning bodies into said tubes.

3. System according to claim 2, wherein said means for collecting comprises a catching device for catching said cleaning bodies whereby said cleaning bodies can be reintroduced into said tubes as desired.

4. System according to claim 3, wherein said catching device comprises a filter positioned along a flow path of said fluid medium for retrieving said cleaning bodies from said fluid medium.

5. System according to claim 3, further comprising a lock downstream of said catching device for filling, retrieving and intermediate storage of said cleaning bodies during interruption of tube cleaning.

6. Cleaning bodies for systems for cleaning tubes of heat exchangers through which a fluid flow medium flows at a temperature in excess of 120° C., wherein said cleaning bodies are adapted to detach deposits adhering to an inner wall of said tubes whereby said deposits are carried out of said tubes when said cleaning bodies pass through said tubes, wherein said cleaning bodies comprise an inner buoyancy element and an outer cleaning element, and wherein said cleaning element forms a contact surface and is a material selected from the group consisting of metal lamellae, knitted metal, metal mesh, and metal foil, and wherein said material is attached to at least one of said buoyancy element and an intermediate element.

7. Cleaning bodies according to claim 6, wherein said cleaning bodies are:

resistant to temperatures in excess of 120° C.;

resistant to crude oil;

have an outer dimension substantially equal to an inner diameter of said tubes; and have an outer contact surface adapted to remove deposits from an inner wall of said tubes whereby during a pass of cleaning bodies through said tubes, deposits adhering to an inner wall of said tubes are detached by said contact surface and carried by at least one of said fluid medium and said cleaning bodies out of said tubes.

8. Cleaning bodies according to claim 7, wherein said cleaning bodies are essentially spherical resilient rolling bodies having a surface, and wherein said surface defines said contact surface for removing deposits from said inner wall of said tubes.

9. Cleaning bodies according to claim 6, wherein said cleaning bodies have a resilient outer diameter which in an uncompressed state is greater than an inner diameter of said tubes and which adapts to said inner diameter when said cleaning bodies are introduced into an inlet opening of said tubes.

10. Cleaning bodies according to claim 6, wherein said buoyancy element is arranged at a center of said cleaning bodies and comprises at least one pressure resistant hollow body.

11. Cleaning bodies according to claim 6, wherein said cleaning element is resilient.

12. Cleaning bodies according to claim 6, wherein a combination of said buoyancy element and said cleaning element has a total weight such that a total specific weight of said cleaning bodies does not differ from a specific weight of said fluid medium by more than about 0.25 $g/cm^3$.

13. Cleaning bodies according to claim 6, wherein said cleaning element forms a contact surface and is a layer of temperature and medium resistant abrasive.

14. Cleaning bodies for systems for cleaning tubes of heat exchangers through which a fluid flow medium flows at a temperature in excess of 120° C., wherein said cleaning bodies are adapted to detach deposits adhering to an inner wall of said tubes whereby said deposits are carried out of said tubes when said cleaning bodies pass through said tubes, wherein said cleaning bodies comprise an inner buoyancy element and an outer cleaning element, further comprising a resilient elasticity medium which carries said cleaning element, wherein said resilient elasticity medium comprises metal foam.

15. Cleaning bodies for systems for cleaning tubes of heat exchangers through which a fluid flow medium flows at a temperature in excess of 120° C., wherein said cleaning bodies are adapted to detach deposits adhering to an inner wall of said tubes whereby said deposits are carried out of said tubes when said cleaning bodies pass through said tubes wherein said cleaning bodies comprise a cleaning element, a resilient medium and a buoyancy element each formed of a material which is resistant to temperatures of at least 120° C. and resistant to said medium, wherein said material is metal.

* * * * *